US005327981A

United States Patent [19]

Morgan

[11] Patent Number: 5,327,981

[45] Date of Patent: Jul. 12, 1994

[54] GROUND WATER SAMPLING DEVICE

[75] Inventor: Michael A. Morgan, Baton Rouge, La.

[73] Assignee: GDC Engineering, Inc., Baton Rouge, La.

[21] Appl. No.: 948,126

[22] Filed: Sep. 21, 1992

[51] Int. Cl.[5] ..... E21B 49/08

[52] U.S. Cl. ..... 175/21; 73/864.74; 166/162

[58] Field of Search ..... 166/264, 162; 175/20, 175/21, 22, 23; 73/864.74

[56] References Cited

U.S. PATENT DOCUMENTS

| | | | |
|---|---|---|---|
| Re. 4,267 | 2/1871 | Duck et al. | 175/22 |
| 64,192 | 4/1867 | Budd . | |
| 576,953 | 2/1897 | Davis | 175/23 |
| 767,209 | 8/1904 | Decker . | |
| 1,211,415 | 1/1917 | Cross . | |
| 1,983,428 | 12/1934 | Zeidler | 166/21 |
| 4,176,716 | 12/1979 | Bielaczek | 166/254 |
| 4,807,707 | 2/1989 | Handley et al. | 175/20 |
| 5,046,568 | 9/1991 | Cordry | 175/21 |
| 5,168,765 | 12/1992 | Broussard | 175/22 X |
| 5,186,263 | 2/1993 | Kejr et al. | 175/20 |

*Primary Examiner*—William P. Neuder
*Attorney, Agent, or Firm*—John H. Runnels

[57] ABSTRACT

A groundwater sampler is disclosed which is adapted for reuse at multiple depths during a single boring, which is simple in design, which may be built with but a small number of parts, which is easy to used which is easy to decontaminate, and which is resistant to clogging from silts and fine sands.

6 Claims, 3 Drawing Sheets 8
2
4

24
8
12

10
2
20
28

14
4

26
6
18
16

GROUND WATER SAMPLING DEVICE

This invention pertains to groundwater sampling devices.

Concern about the environment continues to increase. There is a need for convenient techniques and apparatus to take groundwater samples accurately and easily, to identify locations of pollution, to monitor groundwater quality, and to measure the effects of remediation measures. Groundwater pollution investigations typically require the collection of groundwater samples from several different locations, at various depths. Thus it would be desirable to provide a sampling device which can easily be reused at different locations, particularly one which could be used at multiple depths during a single boring.

One prior method of groundwater sampling is to install a monitor well, and to pump or bail water to the surface for analysis. This method will in many cases be too expensive and inefficient, because a separate well must be constructed at each sample point.

Another general method is to take a sample with a device that is driven into the ground and is designed to be removed from the ground and later reused at other locations. There are several different types of reusable groundwater samplers available on the market today. Reusable groundwater samplers are typically designed to penetrate the earth by being driven to the desired depth by a hydraulic ram or impact hammer, generally in association with a drill rig.

Cordry, U.S. Pat. No. 5,046,568 discloses a groundwater sampler having a drive cone whose diameter is apparently smaller than the diameter of the sampler casing, and in Which the drive cone is designed to remain in the bore hole following the sampling. This patent also discusses other samplers in which the sampler and drive cone are removed after sampling. See col. 1, is line 28 through col. 2, line 7. Bailing is disclosed in col. 8, lines 49–51 and col. 9, lines 31–35.

Other prior patents in the general field of endeavor include U.S. Pat. Nos. 64,192; 767,209; 1,211,415; 1,983,428; 4,176,716; and 4,807,707.

No prior groundwater sampler allows for convenient sampling at multiple depths during a single boring. It would be desirable to have a sampler which is able to do so, because it is often not known in advance at what depth water will be found. Considerable time could be saved if it were possible to take samples at several depths during a single boring, without the necessity of withdrawing the sampler between samples.

There remains a need for a groundwater sampler which is adapted for reuse at multiple depths during a single boring, which is simple in design, which may be built with but a small number of parts, which is easy to use, which is easy to clean, and which is resistant to clogging from silts and fine sands.

These and other objects have been achieved with the novel groundwater sampler of the present invention. The novel sampler may be attached to a drill stem through conventional means, and pushed or driven to the desired depth with an impact device or hydraulic ram. Alternatively a portion of the bore hole may be "pre-drilled" through conventional means to within a short distance of the desired sampling depths and the sampler may then be pushed or driven the remaining distance to the desired depth.

A drive cone is removably attached to the bottom of the sampler, for example through the frictional contact of an O-ring. The drive cone is fixedly attached to a screen, preferably a cylindrical screens contained in the interior of the sampler. The diameter of the drive cone is substantially the same as the diameter of the sampler casing. Once the sampler is at the desired depths a drill stem connected to the top end of the sampler is withdrawn a short distance (e.g., 19 inches or 48 cm) toward the surface. Frictional forces between the drive cone and the soil overcome the force connecting the drive cone to the sampler casing (e.g., the frictional forces from an 0-ring) s causing the drive cone and the screen to stay in place as the sampler casing is retracted. Natural hydrostatic pressure then fills the screen with groundwater from the stratum to which the screen is then exposed. This flow from the formation occurs with little agitation, and therefore with little loss of any volatile compounds that may be present.

Water entering the screen may then be removed for analysis through means known in the art. For example, a bailer of sufficiently small outer diameter (e.g., one inch or 2.5 cm) may be lowered through the drill stem and casing into the interior of the screen. The sample volume is not fixed. If silts or fine sands clog the screens the bailer may be moved up and down within the screen to create agitation to dislodge the unwanted sediment.

It is preferred that the sampler be configured so that the bailer may be lowered to the bottom of the screen. This configuration not only facilitates unclogging the screen as just described, but in conjunction with a small bailer also permits sampling both "sinkers" and "floaters" at the same general depth, i.e., sampling materials which are heavier or lighter than the water which is prevalent in the stratum.

After the groundwater sample has been collected, the entire sampler may be retrieved for cleaning and reuse. The screen is fitted with a shoulder on the top end, which catches a lip within the casing as the casing is further withdrawn toward the surface. As the lip catches the shoulders the screen and drive cone are retrieved from the bore hole along with the casing.

Alternatively this configuration allows the sampler, if desired, to be pushed instead into deeper strata, or to be retracted to shallower strata to obtain additional groundwater samples from the same bore hole during a single boring. When pushed deeper the screen is pushed back into the casing, and the entire sampler may be pushed deeper, and then reopened as before. Alternatively, the sampler (in the open position) may be pulled back to a higher stratum, and a new sample taken as before. For these operations to work properly, it is important that the diameter of the drive cone (i.e., the outer diameter of the drive cone at its widest point) be substantially the same as the outer diameter of the sampler casing. Otherwise contamination of the screen, and thus of the sample, from the mud or other solid particles in the bore hole is likely. Furthermore, having equal diameters seals the portion of the stratum adjacent to the screen, reducing contamination from liquids flowing in a vertical direction.

It is preferred that the upper portion of the drive cone be beveled to facilitate raising the sampler in the bore hole after the sampler has been opened, with minimal contamination resulting from friction between the drive cone and the stratum. Similarly, it is preferred that the lower portion of the sampler casing be beveled to facilitate lowering the sampler in the bore hole after it has been opened.

A sampler in accordance with the present invention can be made of simple construction, making it easy to disassemble and clean. An embodiment of the present invention has been constructed of stainless steel, having a weight of only 22 pounds (10 kg), an outside diameter of 3 inches (7.6 cm), a length of only 29 inches (73.7 cm) in the closed position (about half the length of most groundwater samplers currently on the market), and a length of 47.5 inches (120.7 cm) with the screen exposed in the open position.

Figures 1A, 1B, 1C, 1D, 1E:
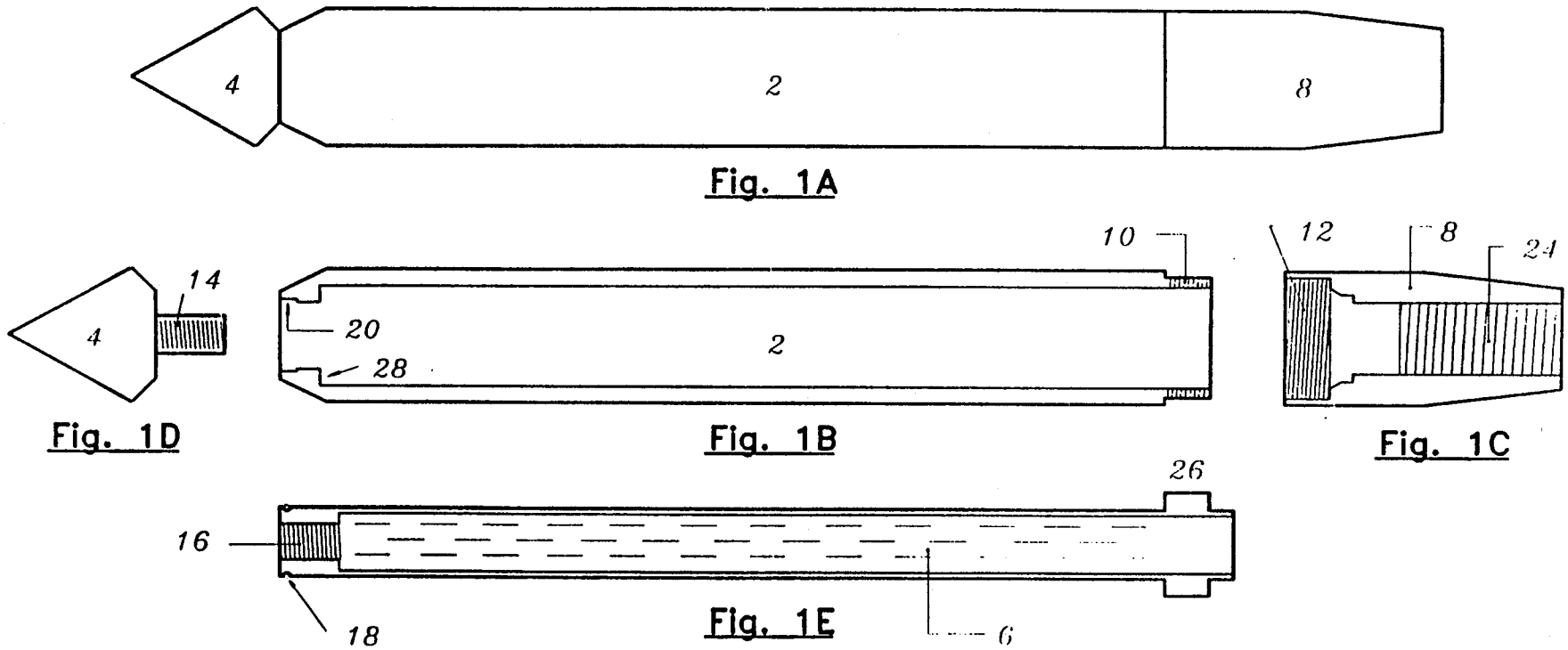
FIG. 1A depicts an external view of an assembled sampler in accordance with the present invention.
FIG. 1B depicts a cross-sectional view of the sampler casing.
FIG. 1C depicts a cross-sectional view of the casing head of the sampler.
FIG. 1D depicts an external view of the drive cone of the sampler.
FIG. 1E depicts a cross-sectional view of the screen of the sampler.
Figure 2:
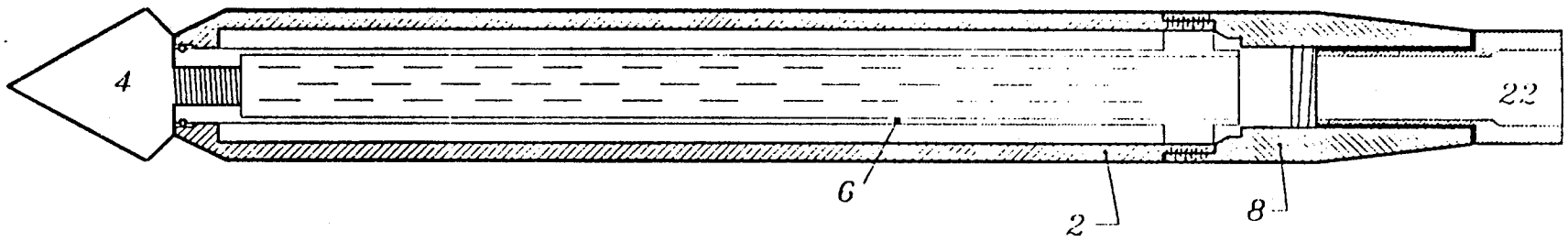
FIG. 2 depicts a cross-sectional view of an assembled sampler.

The Figures illustrate one embodiment of a device in accordance with the present invention. This embodiment may be built from only four parts, as illustrated in FIGS. 1A–1E and FIG. 2.

Referring now to FIGS. 1A–1E and FIG. 2, the sampler comprises casing 2, drive cone 4, cylindrical screen 6, and casing head 8.

Casing 2 is attached to casing head 8 by screw threads 10 and 12. Drive cone 4 is attached to screen 6 by screw threads 14 and 16. When the sampler is closed, drive cone 4 and screen 6 are secured adjacent casing 2, and inside casing 2, respectively, by the friction of O-ring 18 on inner wall 20 of casing 2. Casing head 8 may be attached to a conventional drill stem 22 by means of threads 24.

Figures 3A, 3B, 3C:
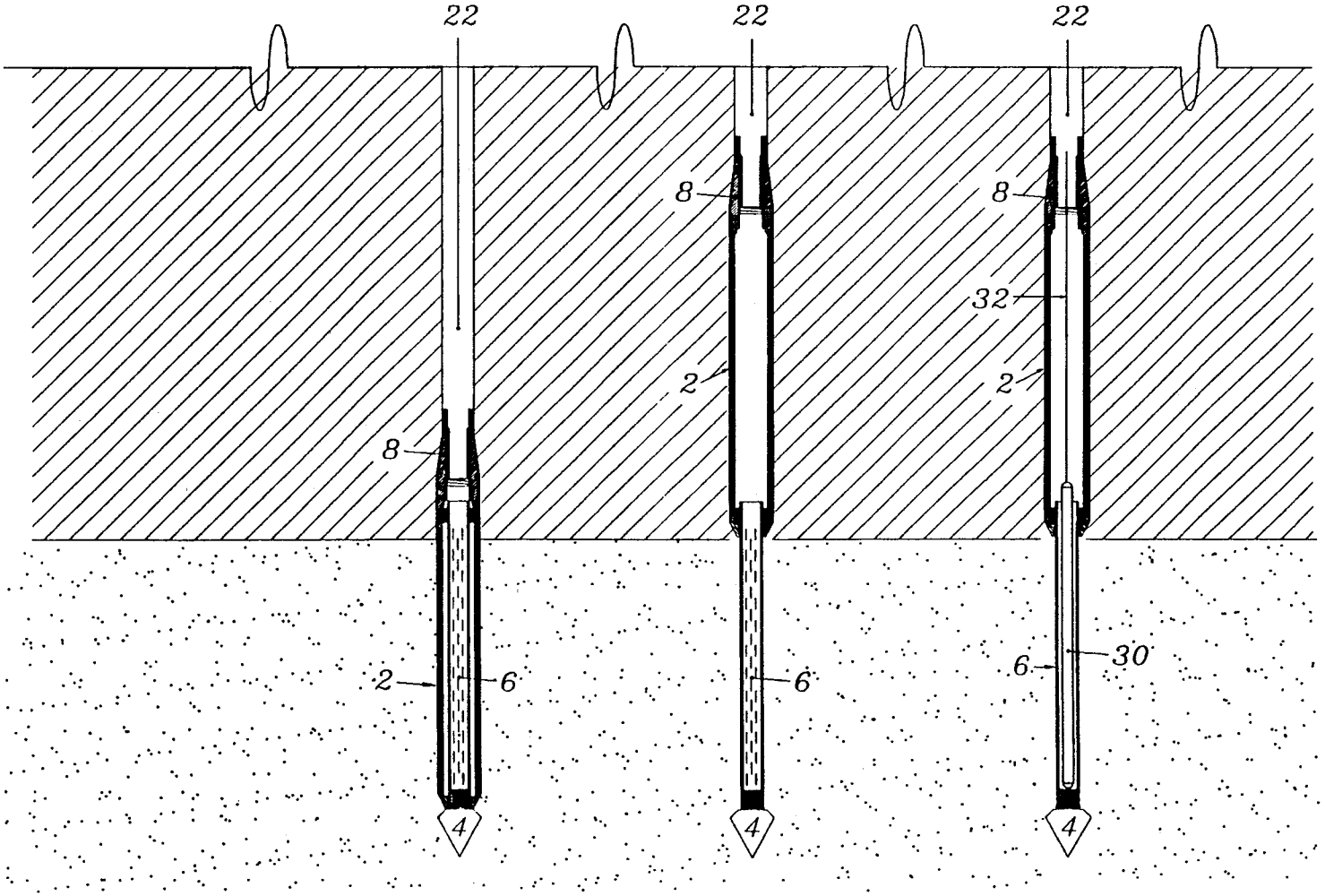
FIG. 3A depicts the sampler in position, in closed configuration.
FIG. 3B depicts the sampler in position, in opened configuration.
FIG. 3C depicts the sampler in position, in opened configurations with groundwater being collected by a bailer.

Referring now to FIGS. 3A–3C, FIG. 3A illustrates the sampler in closed configuration after being driven into a bore hole.

In FIG. 3B, drill stem 22 has been retracted towards the surface slightly (e.g., by about eighteen inches, 46 cm) from its position in FIG. 3A. As drill stem 22 is retracted, it pulls casing head 8 and casing 2 with it. However, frictional forces from the surrounding stratum hold drive cone 4 and screen 6 in place. These frictional forces (particularly, but not limited to, frictional forces on the top, bevelled end of drive cone 4) overcome the frictional forces between 0-ring 18 and inner wall 20 of casing 2, causing 0-ring 18 to become unseated, thereby allowing drive cone 4 and screen 6 to remain in place.

Once the sampler has thus opened, groundwater from the adjacent stratum may flow into screen 6, from which it may be retrieved through means known in the art. For example, as illustrated in FIG. 3C, a bailer 30 may be lowered by stainless steel cable 32 into screen 6 to retrieve a sample. Bailer 30 opens on the bottom, permitting the sampling of either "sinkers" or "floaters" as previously discussed. If silts or fine sand have clogged the openings in screen 6, bailer 30 may be moved up and down to agitate the liquid and dislodge the clogging sediment. As illustrated, this sampler design permits bailer 30 to be lowered substantially to the bottom of screen 6, facilitating any necessary dislodging of such sediment.

In a preferred embodiment, the entire sampler is constructed of stainless steel to minimize contamination resulting from the sampler itself. In a preferred embodiment, the openings in screen 6 are narrow rectangular slits (e.g., 0.5 inch×0.03125 inch, 1.3 cm×0.08 cm), in which the slit cut through the body of the screen cylinder does not end abruptly at the ends of the slit, but rather tapers off gradually to inhibit clogging.

After a sample has been taken, the entire sampler may be raised to the surface by pulling on drill stem 22. As casing 2 then rises, lip 28 of casing 2 catches shoulder 26 of screen 6, pulling screen 6 and drive cone 4 upward as well. Thus the entire sampler may easily be retrieved upon completion, with no components remaining in the bore hole.

While this device has been described in the context of sampling groundwater, those in the art will readily appreciate that it may also be used for sampling other fluids present in a stratum.

I claim:

1. A device for collecting a sample of a fluid in a stratum, comprising:

(a) a casing;

(b) a drive cone adapted for penetrating the stratum;

(c) a screen having an interior, said screen adapted to allow passage of the fluid from the stratum to the interior when said screen is exposed to the fluid, said screen being fixedly attached to or adapted for fixed attachment to said drive cone, and said screen adapted to be removably placed inside said casing;

(d) means for removably attaching said drive cone or said screen to said casing, wherein the force of said attaching means suffices to hold said screen fully within said casing when said device descends into the stratum, but wherein the force of said attaching means is insufficient to hold said screen fully within said casing when said casing is pulled upward through the stratum, whereby following such upward pulling of said casing said screen is withdrawn from said casing and is exposed to the stratum and to any fluid in the stratum; and (e) means for holding said screen to said casing after said screen has been withdrawn from said casing, the force of said holding means being sufficient to pull said screen and said drive cone upward through the stratum when said casing is pulled upward through the stratum;

wherein the diameter of said drive cone is substantially the same as the diameter of said casing, permitting the device to be raised or lowered within the stratum after said screen has been exposed to the stratum and permitting the device to be used to collect a sample of fluid at a different depth within the stratum, without the necessity of first removing the device from the stratum.

2. A device as recited in claim 1, additionally comprising a bailer for removing fluid from the interior of said screen, and wherein said screen is adapted to permit the bailer to be lowered substantially to the bottom of the interior of said screen.

3. A device as recited in claim 1, wherein the top of said drive cone is beveled.

4. A device as recited in claim 1, wherein the bottom of said casing is beveled.

5. A device as recited in claim 1, wherein the top of said drive cone is beveled and the bottom of said casing is beveled.

6. A device as recited in claim 1, additionally comprising a bailer for removing fluid from the interior of said screen, and wherein said screen is adapted to permit the bailer to be lowered substantially to the bottom of the interior of said screen, and wherein the top of said drive cone is beveled and the bottom of said casing is beveled.

* * * * *